United States Patent [19]

Jensen et al.

[11] 4,095,934

[45] Jun. 20, 1978

[54] WASTE GAS RECOVERY

[75] Inventors: Larry F. Jensen, Harbor City; Frank D. Hartzell, Manhattan Beach; William S. Hutchison, Los Angeles, all of Calif.

[73] Assignee: Mobil Oil Corporation, New York, N.Y.

[21] Appl. No.: 780,892

[22] Filed: Mar. 24, 1977

[51] Int. Cl.[2] ..... F23N 1/00

[52] U.S. Cl. ..... 431/89; 431/202

[58] Field of Search ..... 431/89, 90, 202; 137/115, 118

[56] References Cited

U.S. PATENT DOCUMENTS 3,915,620 10/1975 Reed ..... 431/89

*Primary Examiner*—Robert G. Nilson

*Attorney, Agent, or Firm*—Charles A. Huggett; Michael G. Gilman; Raymond W. Barclay

[57] ABSTRACT

An important fuel saving is achieved by recovering fuel gas from the pressure relief system of a processing complex such as an oil refinery without impairing safety features.

3 Claims, 1 Drawing Figure

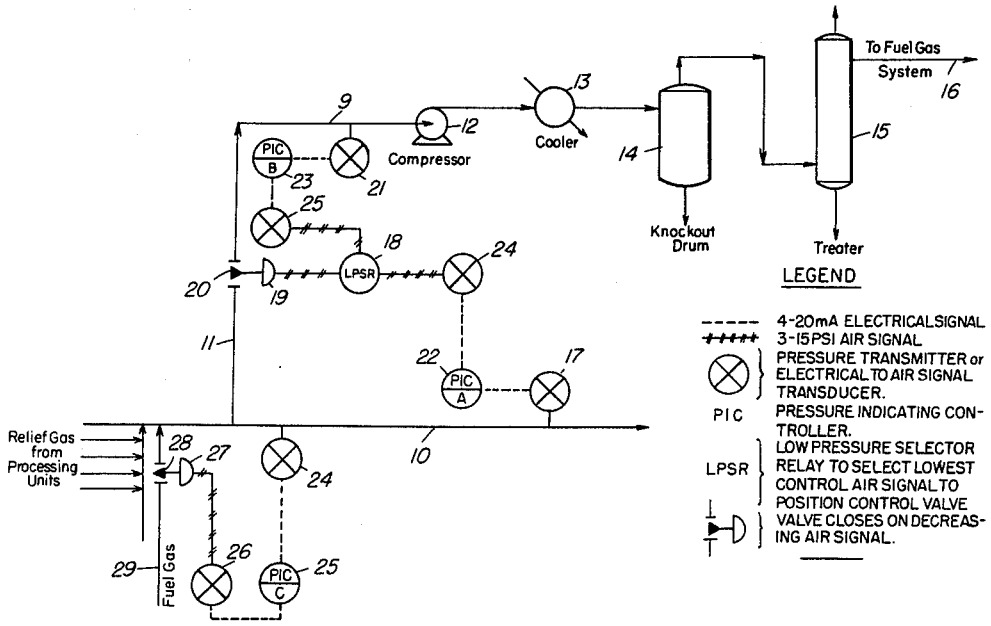

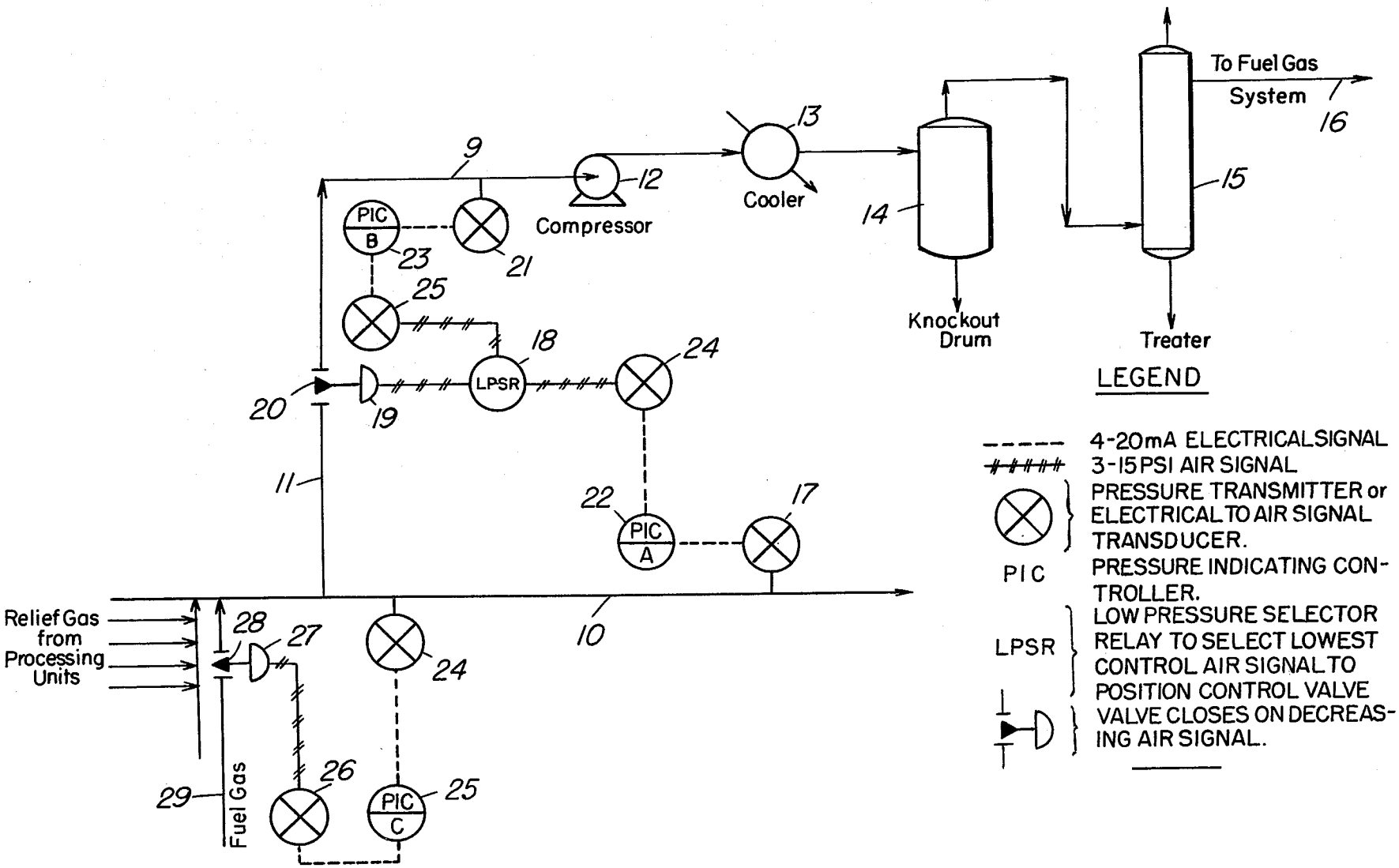
To Fuel Gas System
16
15
Treater
LEGEND
4-20mA ELECTRICAL SIGNAL
3-15PSI AIR SIGNAL
PRESSURE TRANSMITTER or ELECTRICAL TO AIR SIGNAL TRANSDUCER.
PIC
PRESSURE INDICATING CONTROLLER.
LPSR
LOW PRESSURE SELECTOR RELAY TO SELECT LOWEST CONTROL AIR SIGNAL TO POSITION CONTROL VALVE
VALVE CLOSES ON DECREASING AIR SIGNAL.
Knockout Drum
14
13
Cooler
12
Compressor
9
21
PIC B
23
25
18
LPSR
19
20
11
24
PIC A
22
17
10
24
25
PIC C
26
27
28
Fuel Gas
29
Relief Gas from Processing Units

WASTE GAS RECOVERY

BACKGROUND OF THE INVENTION

The invention relates to fuel supply and safety systems of processing complexes wherein combustible raw materials are converted to desired products. It is applicable to such complexes as oil refineries and chemical plants wherein gaseous fuel is consumed in process heaters, gas turbines and the like and wherein a separate system of piping serves to conduct gases from pressure relief valves and the like to means to dispose of these rejected gases, usually by incineration. The known incinerators for the purpose include flare stacks, burning pits and the like.

Obviously, the "waste" gases so consumed by incineration are potential fuels but these have not been used for fuel purposes because means were not available to divert them to furnaces and the like without unacceptable compromise with safety and orderly management of the processing complex.

The facilities in a complex such as a petroleum refinery for applying gaseous fuels to useful purpose operate efficiently only when adjusted for consumption of a fuel having a narrow range of properties such as average molecular weight and heating value and free of contaminants such as sulfur compounds, solid particles and components which may condense to liquid phase in the supply lines. The fuel gas system in a petroleum refinery is further maintained at a pressure which will provide, after pressure drop in the supply system, a suitable pressure at the burners of about 15 to 20 pounds per square inch gauge (psig).

By contrast, the pressure relief system is necessarily of a nature to accept large sudden surges of gas to be dumped to the flare upon opening of a pressure relief valve at a process unit. The composition of such surge of gas can vary over wide limits, from streams that are predominantly hydrogen to those which contain relatively heavy, normally liquid hydrocarbons, compounds of sulfur or nitrogen or any of the myriad of other components found in petroleum processing units.

It is common practice to assure safety of the pressure relief system that it be constituted by relatively large pipes sized to cause little back-pressure against flow of sudden large volumes and that the pressure relief system always maintain a positive flow of gas free of oxygen toward the flare or pit. This maintains a flame at the incinerator device for prompt ignition of gases "dumped" by a pressure relief valve and maintains a pressure in the system greater than atmospheric pressure to prevent leakage of air into the system. That result is normally accomplished by bleeding a small amount of fuel gas to the pressure relief system adjacent each pressure relief valve.

In addition to the gas so deliberately introduced, a significant amount of combustible gas enters the pressure relief system from leaking pressure relief valves. Those valves are generally well seated when first installed but can suffer significant leakage in service before being inspected and replaced. For these reasons, the pressure relief system normally conveys a substantial quantity of fuel to a flare or the like for burning without recovery of the heat generated for useful purpose. This disposal of fuel has been accepted as necessary to safety of the refining complex. It is essential that means be provided to conduct for incineration those surges of gas released when a relief valve opens to protect a process unit against excessive pressure arising from some aberration of process conditions. It is also essential that the pressure relief system be under positive pressure of combustible gas to avoid disastrous mixing with air in the system.

Thus, although it is clearly apparent that a fuel is being consumed on a continuous basis by the pressure relief system, acceptable means for recovery of that heating value in whole or part have not been available. Rather, the normal interaction between fuel gas and pressure relief systems has been to provide for discharge as appropriate from the fuel gas system to the flare or other incinerator. See "Petroleum Processing Handbook" Bland & Davidson; McGraw-Hill (1967), FIG. 8-44.

SUMMARY OF THE INVENTION

A system has now been devised which makes it possible to withdraw from the pressure relief system a maximum amount of fuel gas consistent with safety of the pressure relief system and divert the fuel so withdrawn to the refinery fuel gas supply to boilers, process heaters, engines and turbines. A pipe from the header leading to flares and the like is connected to the suction side of compressor and treater for adjustment of the withdrawn gas to compatibility with the fuel gas for the refinery. A valve in that pipe is motor operated to close in the event of undesirably low pressure in the header or in the event suction in the pipe between valve and compressor drops to level such that flow from the pressure relief system would overload the refinery fuel gas system. An additional safety feature is a repressuring line and valve from the fuel gas system to the flare header arranged for opening of the repressuring valve and supply of fuel gas to the flare header in the event pressure in that header drops. The flare header pressure is thereby maintained above a preset minimum value.

THE DRAWING

A system for practice of the invention is illustrated diagrammatically in the single FIGURE of the annexed drawing.

DESCRIPTION OF PREFERRED EMBODIMENT

The system illustrated in the drawing is essentially modification applied to the normal manifold 9 of the fuel gas system and the normal header 10 for conveying gas to a refinery flare (not shown) or other conventional gas incinerator. As indicated, the gas flowing in header 10 is constituted by collection of many gas streams from individual pressure relief valves at process units. Those streams will be normally constituted by the small amount of refinery fuel gas bled into relief lines adjacent the relief valves and by that amount of gas leaking through such valves. The header 10 is of a size to accomodate large volume flow in the event of a process unit upset, resulting in dumping of a large amount of gas to the relief system, say 24 inches diameter. By reason of gas continuously supplied to the relief system, the header 10 will be under a pressure slightly in excess of atmospheric.

Similarly, gas flowing in manifold 9 is constituted by tail gas from process units and including hydrogen, methane, ethane, carbon monoxide, ethylene together with inert gases and contaminants including carbon dioxide, nitrogen, hydrogen sulfide and water.

For purposes of the present invention, a pipe 11 is provided for withdrawal from header 10 of a portion or all of the gas flowing therein and delivery of the so withdrawn gas to the manifold 9 connecting with the suction side of a compressor 12 in which the gas is compressed to an extent which exceeds that in the refinery fuel gas system by an amount to overcome pressure drop through the treating stages presently to be described.

Depending on nature of the gases in the pressure relief system and the climatic conditions at the refinery, it may be desirable to ensure removal of certain components of the gas to avoid condensation in the fuel gas system. For that purpose, the compressed gas may be passed through a heat exchanger 13 to reduce its temperature and thence to a knockout drum 14 where condensed materials, mostly hydrocarbons, are removed for recycle in the refinery. Undesirable gaseous components such as hydrogen sulfide may be removed by washing with alkali or amine in a treater 15. The gas, now adjusted for compatibility with refinery fuel gas is transferred by line 16 to the refinery fuel gas system.

The operation of this system is subjected to controls responsive to pressures in the header 10 and at the suction side of compressor 12. A pressure sensor 17 detecting static pressure in the header 10 is set at a level to assure that pressure in the header is sufficiently in excess of atmospheric pressure to overcome pressure drop to the flare or other incinerator and provide proper positive pressure at the flare tip, for example. That excess pressure will depend on several factors such as length of the line to the flare, knockout drum at the flare if any and design of the flare itself, all conforming to standard engineering calculations. In the event pressure in header 10 drops to the level of the set point of sensor 17, a signal is transmitted to low pressure switch 18 causing the switch to energize valve actuator 19, causing valve 20 in line 11 to move toward closed position and thus decreasing or arresting diversion of gas from header 10.

A second pressure sensor 21 is adapted to detect pressure in manifold 9 at a point intermediate the compressor 12 and the valve 20. The sensor 21 is set for response to a pressure indicative of full load to the compressor, that is, that the vacuum at suction of the compressor has fallen below design value. Upon detecting a vacuum in manifold 9 less than the set point, sensor 21 transmits a signal to the low pressure switch 18 which causes the valve 20 to move toward closed position.

It will be seen that the low pressure switch 18 is activated by low pressure in header 10 or by reduced suction (vacuum) in manifold 9. Thus overload of the fuel gas system is avoided regardless of flow in the pressure relief system. In addition, when flow in the relief gas system is only adequate for maintenance of standby conditions to the flare, diversion of gas from that purpose is avoided. The invention thereby makes it possible to withdraw maximum fuel gas from the pressure relief system without introducing hazards of explosion conditions due to mixing of air and combustible gas, or of disruption to normal operation of the fuel gas system.

Valve 20 is a throttling type control valve positioned by a pneumatic, spring-and-diaphragm actuator 19. A variable 3–15 psig air signal connected to the diaphragm will position the valve between the closed position (3 psig air signal) and (15 psig air signal) fully open position.

A description of the control system as applied in the typical installation shown in the drawing follows:

Two pressure indication controllers 22 and 23, bearing legends PIC-A and PIC-B, are installed in the control center with electrical input signals from the pressure transmitters, 17 and 21, and with electrical output control signals from the controllers to field mounted current to air transducers 24 and 25 which provide equivalent 3–15 psig control signals to a low pressure selector relay 18. LPSR 18 selects the 3–15 psig control signal with the lowest pressure value to operate diaphragm actuator 19 and position control valve 20.

Set point of flare system pressure indicating controller 22 (PIC-A) is 5 inches of water pressure with direct acting control to increase output signal and open vapor recovery valve 20 on increasing flare system 10 pressure.

Set point of vapor recovery line pressure indicating controller 23 (PIC-B) is 5.5 inches of mercury vacuum with direct acting control to decrease output signal and close vapor recovery valve 20 on decreasing vacuum in vapor recovery line 9.

Normally the vapor recovery line 9 is above 5.5 inches of mercury vacuum and PIC-B controller 23 is off control with a 15 psig or higher control signal to LPSR 18. PIC-A controller 22 is on control at this time controlling the flare system header 10 at 5 inches of water pressure with an output signal, through LPSR 18, of some value between 3 and 15 psig necessary to partially open control valve 20 and allow recovery of relief gas to compressor 12. As the flow rate of relief gas from the process units increases or decreases PIC-A controller 22 will automatically increase or decrease control valve 20 opening.

When, due to abnormally high vapor recovery flow rates, compressor 12 becomes overloaded the vapor recovery line 9 vacuum will decrease to the 5.5 inches of mercury vacuum set point of PIC-B controller 23. PIC-B will go on control with an output signal to LPSR 18 lower than the output signal from PIC-A controller 22. LPSR 18 will select this lower signal to partially close control valve 20, reduce the compressor 12 loading and control the vapor recovery line at 5.5 inches of mercury vacuum. At this time the flare system 10 pressure will increase above 5 inches of water, PIC-A controller 22 output signal will increase to 15 psig or more and the excess gas will flow to the flare for incineration.

As the relief gas from the process units flow rate returns to normal, compressor 12 will reduce the flare system header 10 pressure to the set point of PIC-A controller 22. PIC-A controller 22 will take control of control valve 20 through LPSR 18 with an output signal less than the control signal from PIC-B controller 23, controlling the flare system 10 at 5 inches of water pressure with PIC-B controller 23 off control and vapor recovery line 9 vacuum above 5.5 inches of mercury.

To prevent the loss of positive flare system pressure, due to gas leakage to the flares or through control valve 20 during abnormally low relief gas flow rates, a controller is provided to repressure and control the flare system at a minimum pressure of 2 inches of water.

A pressure sensor 24 detects pressure in header 10 and transmits an electrical signal to pressure indicating controller 25 (legend PIC-C) at the control center from which an electrical signal is transmitted to transducer 26 in the field for conversion to a pneumatic signal for control of valve actuator 27 which affects position of valve 28 in line 29 supplied by the refinery fuel gas system.

Set point of controller 25 (PIC-C) is 2 inches of water pressure with direct acting control to decrease output signal and open fuel gas control valve on decreasing flare system pressure. Normally PIC-C output signal is 15 psig or more and the fuel gas valve 28 is closed.

We claim:

1. In a complex of process units for conversion of combustible feed materials to desired products having a common fuel gas system for supply of fuel gas to individual process units, a common relief system for collection of combustible gases at pressure relief devices associated with said process units, an incinerator, a pressure relief header connected to said incinerator for discharge into said incinerator, and means to supply said combustible gas so collected to said header; the improvement to permit recovering fuel value of the said collected combustible gases to the maximum extent consistent with safety of the said complex which comprises:

(1) compressor means adapted to compress said collected combustible gases to the pressure of said fuel gas system, (2) means to conduct gases discharged from said compressor means into said fuel gas system, (3) a gas supply conduit communicating with said header and with intake of said compressor means, (4) a control valve in said conduit adapted to close the same, (5) means to generate a signal representative of pressure in said header, (6) means to generate a signal representative of vacuum in said conduit between said valve and the intake of said compressor means, (7) means responsive to said signals adapted to close said valve when the lesser of said signals is below a predetermined minimum.

2. A complex according to claim 1 including means to treat the discharge of said compressor means to remove therefrom components undesirable in said fuel gas system.

3. A complex according to claim 1 including means for maintaining pressure in said header above a predetermined minimum which means comprise a pressuring conduit for supply of fuel gas to said header, a normally closed valve in said pressuring conduit, a valve actuator operatively connected to open said valve, a sensor to detect pressure in said header and a signal system responsove to said sensor and adapted to activate said valve actuator to open said valve upon detection by said sensor of a pressure in said header below said predetermined minimum.

* * * * *